US005475351A

United States Patent [19]

Uematsu et al.

[11] Patent Number: 5,475,351

[45] Date of Patent: Dec. 12, 1995

[54] NON-CONTACT ROTATING COUPLER

[75] Inventors: Masahiro Uematsu; Takashi Ojima, both of Tokyo; Kazuo Kato, Yokohama, all of Japan

[73] Assignees: Nippon Steel Corporation, Tokyo; Systems Uniques Corporation, Kanagawa, both of Japan

[21] Appl. No.: 317,618

[22] Filed: Sep. 26, 1994

[30] Foreign Application Priority Data

Sep. 24, 1993 [JP] Japan ..... 5-258992

[51] Int. Cl.[6] ..... H01P 1/06

[52] U.S. Cl. ..... 333/261; 333/24 C

[58] Field of Search ..... 333/24 C, 261

[56] References Cited

U.S. PATENT DOCUMENTS 3,013,225 12/1961 Ouchi ..... 333/24 R 4,988,963 1/1991 Shirosaka et al. ..... 333/261

5,057,847 10/1991 Väisänen ..... 333/24 C X

FOREIGN PATENT DOCUMENTS 0373604 6/1990 European Pat. Off. .

2643749 8/1990 France .

*Primary Examiner*—Paul Gensler

*Attorney, Agent, or Firm*—Pollock, Vande Sande & Priddy

[57] ABSTRACT

A non-contact rotating coupler for transmitting a signal through coupling capacitances formed between opposite coupling plates arranged apart from each other. In the coupling plate, an inductance for causing a parallel resonance in a signal frequency band with a stray capacity existing between a grounded conductor and a non-grounded conductor is connected between a junction point of a resistor and a capacitor and the grounded conductor or between the non-grounded conductor and the grounded conductor, thereby reducing a coupling loss.

21 Claims, 5 Drawing Sheets

NON-CONTACT ROTATING COUPLER

FIELD OF THE INVENTION

The present invention relates to a non-contact rotating coupler used in an antenna device such as an antenna for reception of satellite broadcasting, and more particularly to a non-contact rotating coupler in which a reduction in coupling loss is contemplated.

BACKGROUND OF THE INVENTION

Recently, there has rapidly been developed an antenna for reception of satellite broadcasting which is to be mounted to a moving body such as sightseeing bus, personal vehicle and RV (recreational vehicle). In this kind of vehicle-mounted antenna, the direction of a broadcasting satellite (BS) seen from the antenna changes momentarily with a change in route of the vehicle or the like. Therefore, it becomes necessary to perform a tracking operation for controlling the azimuth angle and the elevation angle of the antenna so that the antenna is always directed towards the broadcasting satellite. As a result, it is required that a rotating coupler for allowing the antenna to make a relative rotation while maintaining the electrical coupling of a signal frequency band should be provided a feeder line which connects the antenna and a tuner. Such a rotating coupler may include a high frequency type rotating coupler which is provided between a rotating antenna and a stationary converter in order to couple a receive signal having a frequency in the vicinity of 12 GHz. In another type of rotating coupler, an antenna and a converter are integrated with each other and a receive signal having a frequency in the vicinity of 12 GHz is converted once by the converter into an intermediate frequency signal having a frequency of about 1 GHz. This type of rotating coupler or a low frequency type rotating coupler is provided a transmission path of the intermediate frequency signal. Both types of rotating couplers have their merits and demerits. But, the low frequency type rotating coupler is regarded as being advantageous with respect to electrical characteristics such as S/N ratio and frequency characteristic.

The low frequency type rotating coupler as mentioned above has a structure shown in FIGS. 4A and 4B. As shown in FIG. 4A, a coupling plate 30 includes an insulating plate 31, a non-grounded (or hot side) conductor plate 32 formed on one of opposite surfaces of the insulating plate 31, a grounded conductor plate 33 formed on the other surface thereof, and a series connection of an impedance matching resistor R1 and a DC blocking capacitor C1 provided between the non-grounded conductor plate 32 and the grounded conductor plate 33. Reference numeral 34 denotes a conductor plate which is formed on the one surface of the insulating plate 31 so as to enclose the non-grounded conductor plate 32. One terminal of the capacitor C1 is connected to a conductor which extends through the insulating plate 31 and is connected to the non-grounded conductor plate 32 formed on the one surface of the insulating plate 31. As shown in FIG. 4B, the coupling plate 30 and a coupling plate 40, having the same structure as the coupling plate 30, are arranged apart from each other and opposing each other so that a coupling capacitance is formed by the non-grounded conductor plates 32 of the coupling plates 30 and 40 and a gap provided therebetween. Coaxial connectors 35 and 45 are connected to the coupling plates 30 and 40, and the coupling plates are rotatably held to face each other by holding mechanisms (not shown) provided on the peripheral portions.

FIG. 5 shows an equivalent circuit of the rotating coupler having the structure shown in FIGS. 4A and 4B. A coupling capacitance C2 is formed by the non-grounded conductor plates of the two coupling plates and a gap provided therebetween, and a coupling capacitance C3 is formed by the grounded conductor plates of the two coupling plates and a gap provided therebetween. The coupling capacitance C3 includes a series connection of a coupling capacitance formed by the grounded conductor plate 33 and the conductor plate 34 of one of the two coupling plates and the insulating plate 31 interposed therebetween, a similar coupling capacitance formed by the other coupling plate, and a coupling capacitance formed between the two conductor plates 34. In each coupling plate, the electrostatic capacitance C1 or C4 of the DC blocking capacitor and the resistor R1 or R2 are connected in series with each other between the non-grounded conductor plate and the grounded conductor plate. Reference symbol Ro denotes an output resistor on the converter side, and symbol RL denotes a load resistor on the tuner side.

A problem encountered in the non-contact rotating coupler having the structure shown in FIGS. 4A and 4B and the equivalent circuit shown in FIG. 5 is how to reduce a coupling loss. It is therefore required that the coupling capacitances C2 and C3 be made sufficiently large. In order to make the coupling capacitance sufficiently large, it is necessary not only to make the area of each conductor plate sufficiently large but also to make an interval between the two coupling plates sufficently narrow. However, aside from the grounded conductor plate, there is a limit to enlargement of the area of the non-grounded conductor plate formed at the central portion. Also,, the reduction of the interval between the coupling plates has a limit from the mechanical precision and stability point of view.

SUMMARY OF THE INVENTION

While having had worked hard to obtain large coupling capacitances, the present inventors have had a suspicion that the equivalent circuit shown in FIG. 5 may not be accurate as the equivalent circuit of the non-contact rotating coupler shown in FIGS. 4A and 4B and in fact, stray capacities CS1 and CS2 formed between the non-grounded conductor plate and the grounded conductor plate as shown in FIG. 6 may have a large influence on the coupling loss. If such stray capacities CS1 and CS2 are considerably large, the impedance of the line is greatly reduced, thereby bringing about a large impedance mismatching. As a result, the increase of the coupling loss caused by the absorption or reflection of a signal may be more important than the small value of the coupling capacitances C2 and C3. Also, enlarging of the area of the non-grounded conductor plate 32 in order to increase the coupling capacitance C2 may have a reverse effect since it is supposed that such enlargement may be accompanied by the increase of the stray capacities CS1 and CS2.

SUMMARY OF THE INVENTION

In a non-contact rotating coupler according to the present invention aimed to solve the above-mentioned problem of the prior art, at least one of two coupling plates is provided with an inductor which causes a parallel resonance in a signal frequency band with a stray capacity existing between a grounded conductor plate and a non-grounded conductor plate and which is connected between the grounded conductor plate and the non-grounded conductor plate or between a junction point of a DC blocking resistor and an impedance matching capacitor and the grounded conductor plate.

With the construction in which the inductor making the parallel resonance with the stray capacity in the signal frequency band is additionally provided to the coupling plate, the influence of the stray capacity is eliminated. As a result, a coupling loss caused by the short-circuiting of a signal path due to the stray capacity is eliminated, thereby reducing the coupling loss. Also, the increase of the coupling capacitance C2 or C3 resulting from the increase of the area of the non-grounded conductor becomes possible leaving the increase of the stray capacity out of consideration.

DESCRIPTION OF THE PREFERRED EMBODIMENTS

Figure 1A:
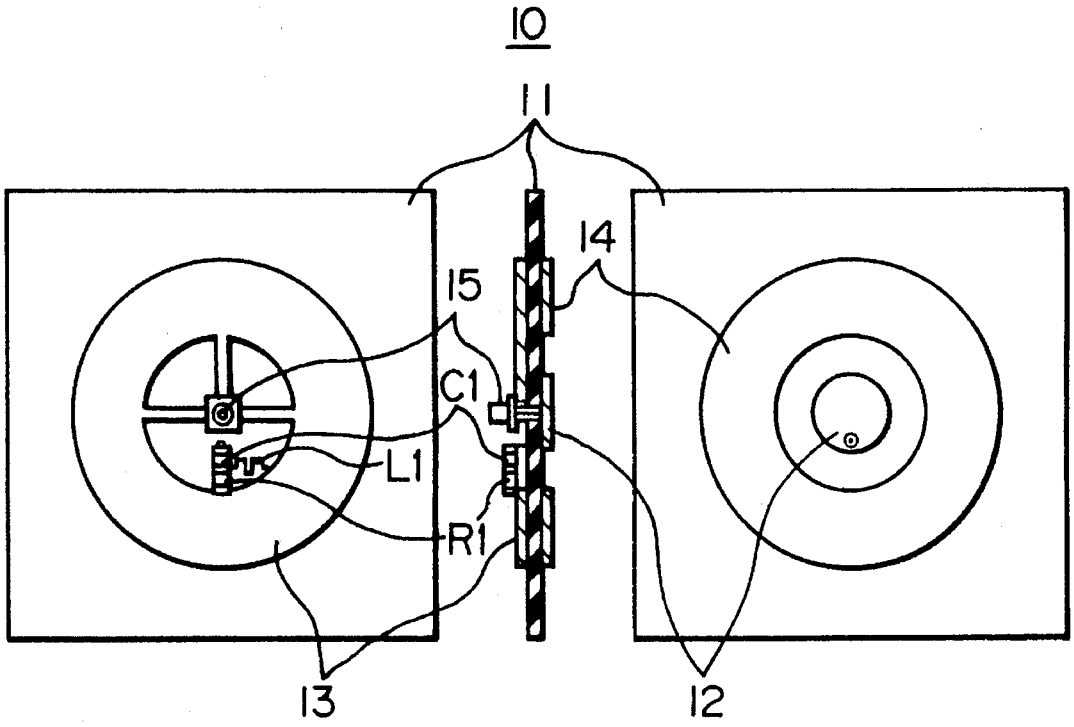
FIG. 1A shows in plan, bottom and cross-sectional views the construction of each coupling plate forming a non-contact rotating coupler according to an embodiment of the present invention.

FIG. 1A shows in plan, bottom and cross-sectional views the construction of each coupling plate forming a non-contact rotating coupler according to an embodiment of the present invention. A coupling plate 10 includes an insulating plate 11, a non-grounded (or hot side) conductor plate 12 formed on one of opposite surfaces of the insulating plate 11, a grounded conductor plate 13 formed on the other surface thereof, and a series connection of an impedance matching resistor R1 and a DC blocking capacitor C1 provided between the non-grounded conductor plate 12 and the grounded conductor plate 13. A conductor plate 14 is formed on the one surface of the insulating plate 11 so as to enclose the non-grounded conductor plate 12. Each conductor plate may include a copper foil formed on a printed wiring board or may include any thick-film conductor or thin-film conductor formed by a well known method. One terminal of the capacitor C1 is connected to a conductor which extends through the insulating plate 11 so that it is connected to the non-grounded conductor plate 12 formed on the one surface of the insulating plate 11. Further, a distributed constant inductor L1 is connected between a junction point of the resistor R1 and the capacitor C1 and the grounded conductor plate 13. The inductor may include a plate-like conductor or a conductor with a bent pattern which is formed in a manner similar to the conductor plate mentioned above and is a copper foil, a thick-film conductor or a thin-film conductor.

Figure 2A:
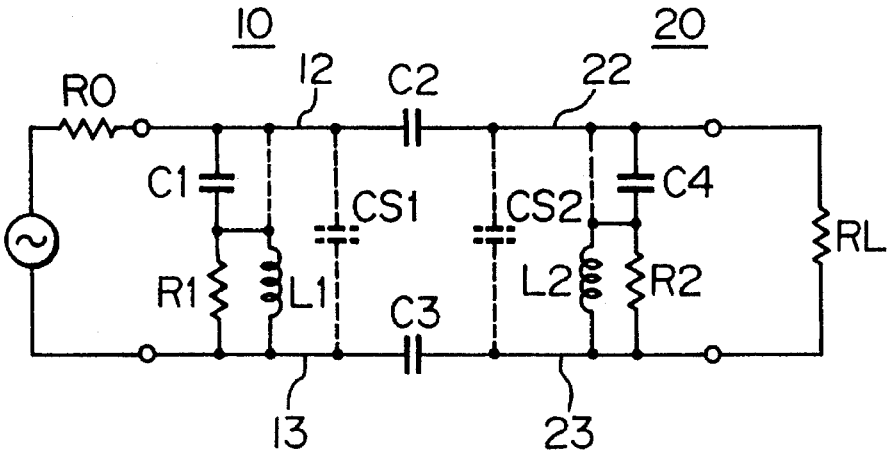
FIG. 2A shows an equivalent circuit of the non-contact rotating coupler of the embodiment of the present invention.
Figure 4A:
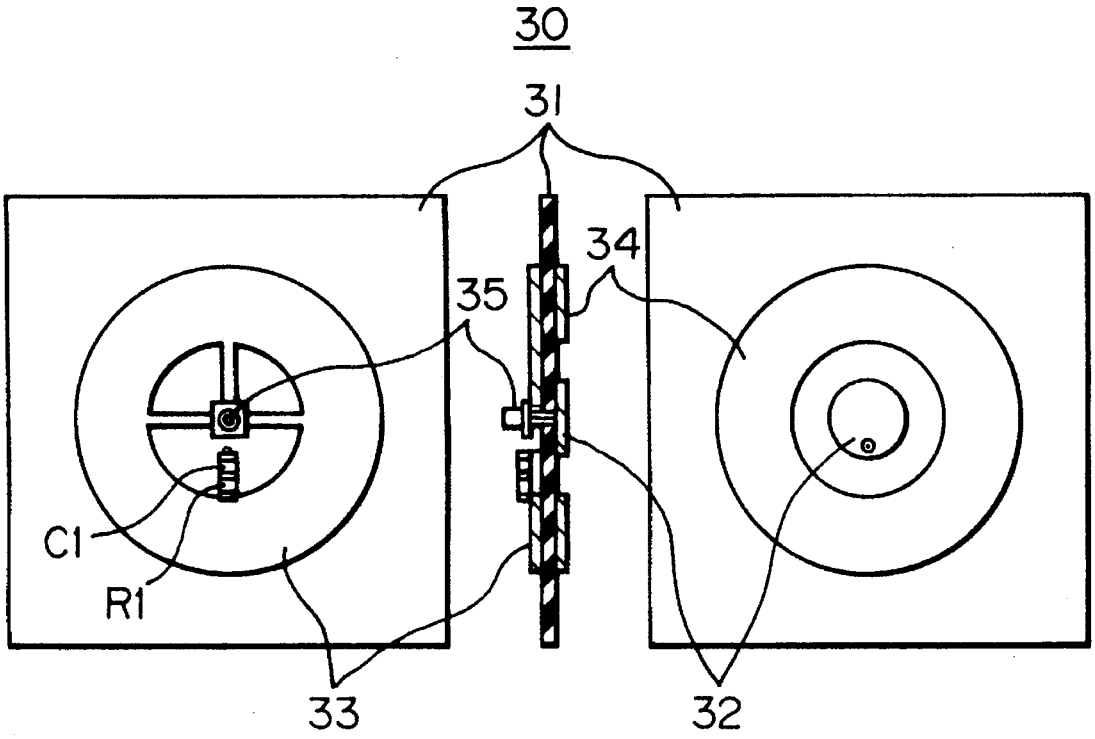
FIG. 4A PRIOR ART
FIG. 4A shows in plan, bottom and cross-sectional views the construction of each coupling plate forming the conventional non-contact rotating coupler.
Figure 4B:
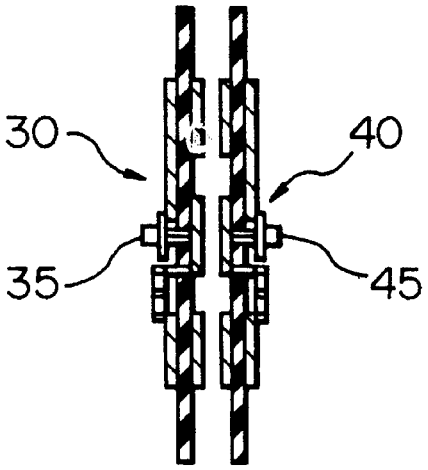
FIG. 4B PRIOR ART
FIG. 4B shows a cross section of the the conventional non-contact rotating coupler formed by two coupling plates.
Figure 5:
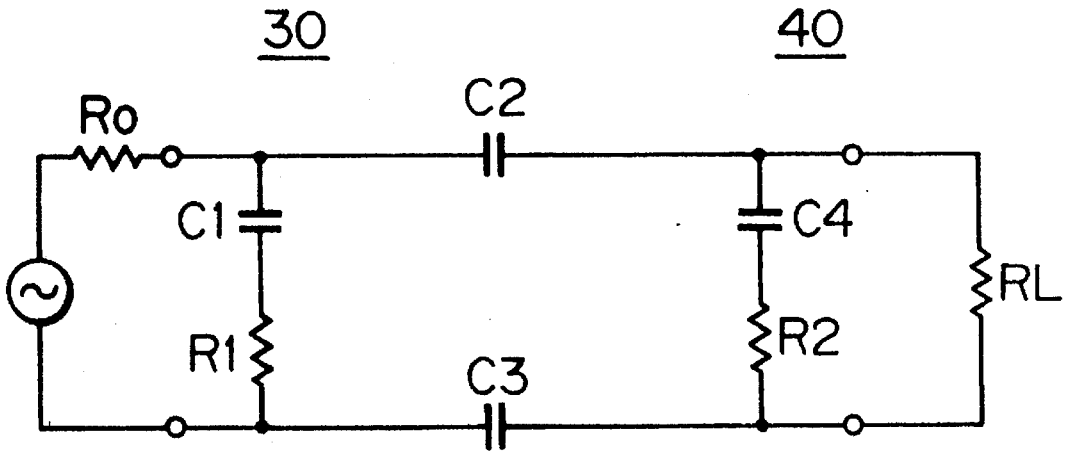
FIG. 5 PRIOR ART
FIG. 5 shows an equivalent circuit of the conventional non-contact rotating coupler.
Figure 6:
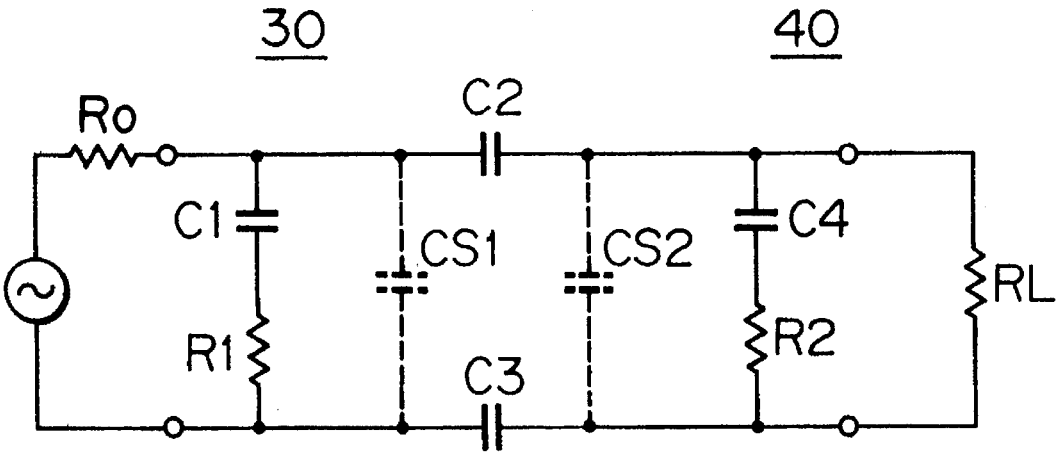
FIG. 6 shows an improved equivalent circuit of the conventional non-contact rotating coupler.

A non-contact rotating coupler is constructed by arranging the coupling plate 10 and a coupling plate 20 of the same structure as the coupling plate 10 apart from each other and to oppose each other, in a manner similar to that shown in FIG. 4B, so that a coupling capacitance is formed by the non-grounded conductor plates 12 of the coupling plates 10 and 20 and a gap provided therebetween. An equivalent circuit of the non-contact rotating coupler is shown in FIG. 2A. Considering a relationship CS1<<C1 and CS2<<C4 in magnitude between the stray capacity and the capacitance of the DC blocking capacitor for the equivalent circuit of each coupling plate in the vicinity of a resonance frequency, the capacitor CS1 and the inductance L1 of the coupling plate 10 may be regarded as substantially connected in parallel with each other between the non-grounded conductor and the grounded conductor whereas the capacitor CS2 and the inductance L2 of the coupling plate 20 may be regarded as substantially connected in parallel with each other between the non-grounded conductor and the grounded conductor.

If the inductance of the inductor L1 is selected so that the stray capacity CS1 and the inductor L1 take a parallel resonance condition substantially in a center frequency of an intermediate frequency signal, this parallel resonance circuit approaches an open condition, thereby eliminating a short-circuited condition of a signal line caused by the stray capacity CS1. Similarly, if the inductance of the inductor L2 is selected so that the stray capacity CS2 and the inductor L2 take a parallel resonance condition substantially in a center frequency of the intermediate frequency signal, this parallel resonance circuit approaches an open condition, thereby eliminating a short-circuited condition of a signal line caused by the stray capacity CS2. As a result, a coupling loss is greatly reduced.

Figure 1B:
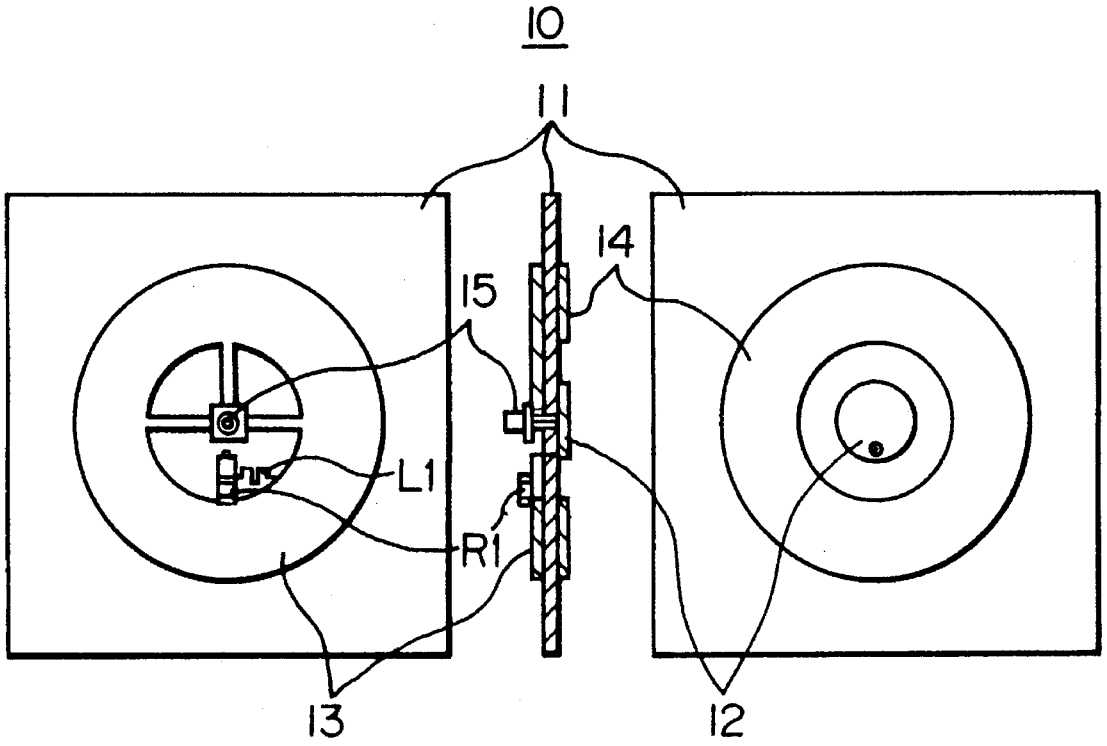
FIG. 1B shows another embodiment of the present invention.
Figure 3:
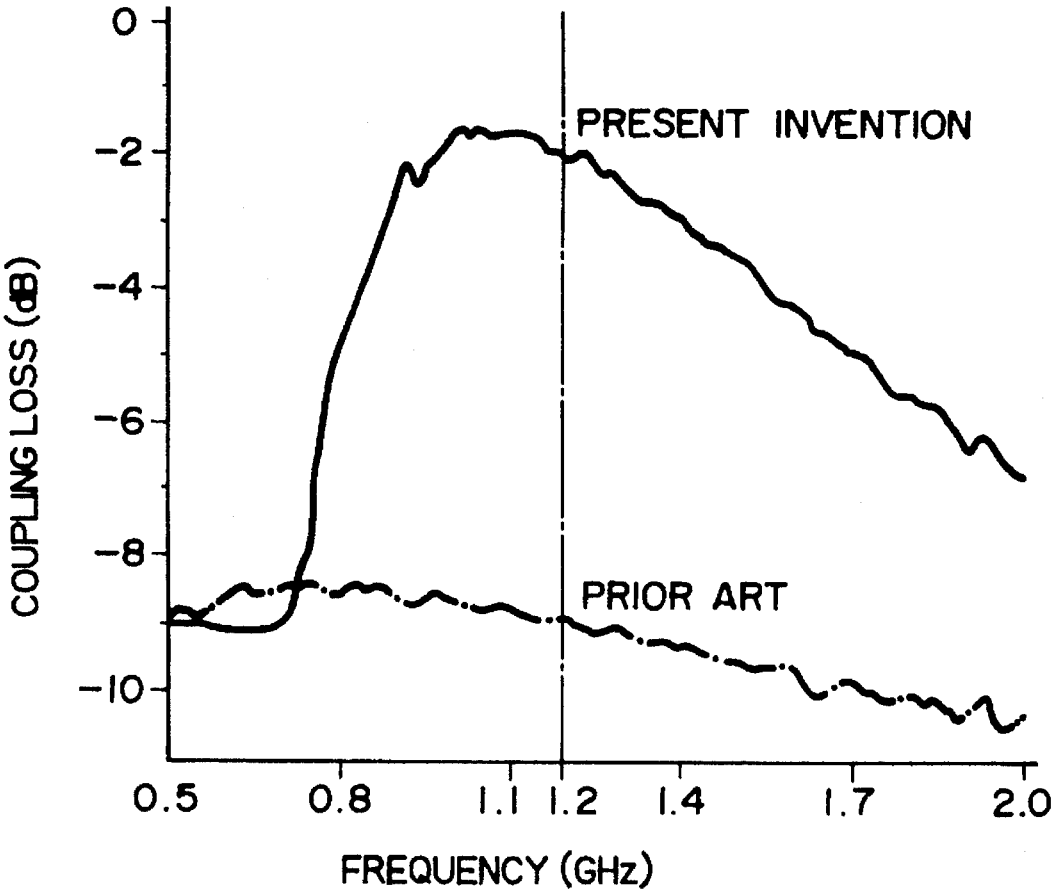
FIG. 3 shows measured data of a coupling loss of the non-contact rotating coupler of the embodiment of the present invention in comparison with that of the conventional non-contact rotating coupler.

FIG. 3 shows data of a coupling loss actually measured in an intermediate frequency band. In FIG. 3, a solid line represents a coupling loss of the non-contact rotating coupler of the present embodiment using the coupling plate shown in FIG. 1 and a one-dotted chain line represents a coupling loss of the conventional non-contact rotating coupler shown in FIG. 4A. It is apparent from FIG. 3 that the coupling loss in the center frequency of 1.2 GHz is reduced by about 7 dB as the result of addition of the inductor.

In the present embodiment, the inductor (L1 or L2) has been provided to each of the opposing coupling plates 10 and 20. However, considering the condition where the coupling capacitance C2 or C3 is sufficiently large as compared with the stray capacity CS1 or CS2, the inductor may be provided in only one of the coupling plates 10 and 20.

Figure 2B:
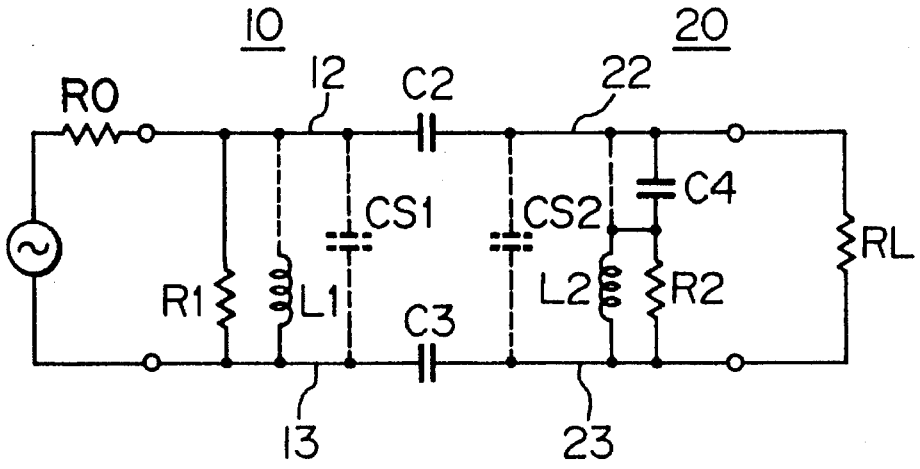
FIG. 2B shows an equivalent circuit of the embodiment of the present invention shown in FIG. 1B.

The present embodiment has been shown in conjunction with the structure in which the DC blocking capacitor is arranged on the coupling plate. However, in the case where a signal includes no DC component or in the case where a DC blocking capacitor is arranged on the signal source or load side, the DC blocking capacitor on the coupling plate can be omitted (see FIG. 1B). In this case, one end of the resistor R1 or R2 and one end of the inductor L1 or L2 may be connected to the non-grounded conductor plate 12 or 22 directly, as shown in FIG. 2B.

Considering the condition where the area of the grounded conductor 13 is sufficiently large as compared with that of the non-grounded conductor plate 12, the conductor plate 14 on the one surface of the insulating plate 11 can be omitted while the coupling capacitance C3 is decreased. To the contrary, there may be employed a construction in which the coupling capacitance C3 is further increased by directly connecting the conductor plate 14 on the one surface of the insulating plate 11 and the grounded conductor plate 13 on the other surface thereof by means of a proper conductor which extends through the insulating plate 11.

As has been explained in detail in the foregoing, the non-contact rotating coupler of the present invention has a construction in which the influence of the stray capacity is removed by providing an inductor for at least one of opposed coupling plates which inductor makes a parallel resonance with a stray capacity in a signal frequency band. Therefore, a coupling loss caused by the absorption or reflection of a signal resulting from an impedance mismatching caused by the stray capacity is eliminated, thereby attaining a great reduction in coupling loss, as proved by experimental data.

Also, since the influence of the stray capacity is ultimately removed, the increase of the coupling capacitance C2 or C3 between the coupling plates resulting from the increase of the area of the non-grounded conductor can be attained leaving the increase of the stray capacity out of consideration.

We claim:

1. A non-contact rotating coupler comprising two coupling plates each including:

an insulating plate having opposite surfaces;

a first conductor formed on one of the opposite surfaces of said insulating plate;

a second conductor formed on the other of the opposite surfaces of said insulating plate; and a series connection of a DC blocking capacitor and an impedance matching resistor connected between said first and second conductors, wherein:

said two coupling plates are arranged apart form each other and opposing each other so that a coupling capacitance is formed by the first conductors of said two coupling plates and a gap is provided therebetween; and at least one of said two coupling plates further includes an inductor connected between a junction point of said resistor and said capacitor and one of said first and second conductors which is connected to said impedance matching resistor so that said inductor causes a parallel resonance in a signal frequency band with a stray capacity existing between said first and second conductors.

2. A non-contact rotating coupler according to claim 1, wherein each of said first and second conductors includes a conductor plate.

3. A non-contact rotating coupler according to claim 1, wherein each of said first and second conductors includes a conductor foil.

4. A non-contact rotating coupler according to claim 1, wherein said inductor includes a conductor plate having a bent pattern.

5. A non-contact rotating coupler according to claim 1, wherein said inductor includes a conductor foil having a bent pattern.

6. A non-contact rotating coupler according to claim 1 wherein one of said first and second conductors is a non-grounded conductor and the other of said first and second conductors is a grounded conductor.

7. A non-contact rotating coupler according to claim 1, wherein each of said coupling plates further includes a third conductor formed on the one surface of said insulating plate to enclose said first conductor.

8. A non-contact rotating coupler according to claim 7, wherein each of said first, second and third conductors includes a conductor plate.

9. A non-contact rotating coupler according to claim 7, wherein each of said first, second and third conductors includes a plate formed of a conductor foil.

10. A non-contact rotating coupler according to claim 7, wherein said inductor includes a conductor plate having a bent pattern.

11. A non-contact rotating coupler according to claim 7, wherein said inductor includes a conductor foil having a bent pattern.

12. A non-contact rotating coupler comprising two coupling plates each including:

an insulating plate having opposite surfaces;

a first conductor formed on one of the opposite surfaces of said insulating plate;

a second conductor formed on the other of the opposite surfaces of said insulating plate; and an impedance matching resistor connected between said first and second conductors, wherein:

said two coupling plates are arranged apart form each other and opposing each other so that a coupling capacitance is formed by the first conductors of said two coupling plates and a gap provided therebetween; and at least one of said two coupling plates further includes an inductor connected between said first and second conductors so that said inductor causes a parallel resonance in a signal frequency band with a stray capacity existing between said first and second conductors.

13. A non-contact rotating coupler according to claim 12, wherein each of said first and second conductors includes a conductor plate.

14. A non-contact rotating coupler according to claim 12, wherein each of said first and second conductors includes a plate formed of a conductor foil.

15. A non-contact rotating coupler according to claims 12, wherein said inductor includes a conductor plate having a bent pattern.

16. A non-contact rotating coupler according to claim 12, wherein said inductor includes a conductor foil having a bent pattern.

17. A non-contact rotating coupler according to claim 12, wherein each of said coupling plates further includes a third conductor formed on the one surface of said insulating plate to enclose said first conductor.

18. A non-contact rotating coupler according to claim 17, wherein each of said first and second conductors includes a conductor foil.

19. A non-contact rotating coupler according to claim 17, wherein each of said first, second and third conductors includes a conductor foil.

20. A non-contact rotating coupler according to claims 17, wherein said inductor includes a conductor plate having a bent pattern.

21. A non-contact rotating coupler according to claim 17, wherein said inductor includes a conductor foil having a bent pattern.

* * * * *